US011248513B2

(12) United States Patent
Zdravkov

(10) Patent No.: US 11,248,513 B2
(45) Date of Patent: Feb. 15, 2022

(54) SILENCER INSERT, SILENCER COMPRISING THE SAME AND METHOD FOR MANUFACTURING A SILENCER INSERT

(71) Applicant: Eberspächer Exhaust Technology GmbH & Co. KG, Neunkirchen (DE)

(72) Inventor: Hristo Zdravkov, Stuttgart (DE)

(73) Assignee: PUREM GMBH, Neunkirchen (DE)

( * ) Notice: Subject to any disclaimer, the term of this patent is extended or adjusted under 35 U.S.C. 154(b) by 664 days.

(21) Appl. No.: 16/166,566

(22) Filed: Oct. 22, 2018

(65) Prior Publication Data

US 2019/0120115 A1 Apr. 25, 2019

(30) Foreign Application Priority Data

Oct. 23, 2017 (DE) ..... 10 2017 124 750.5

(51) Int. Cl.
*F01N 13/18* (2010.01)
*F01N 1/02* (2006.01)
*F01N 1/08* (2006.01)

(52) U.S. Cl.
CPC ..... *F01N 13/1872* (2013.01); *F01N 1/023* (2013.01); *F01N 1/08* (2013.01); *F01N 1/084* (2013.01); *F01N 13/185* (2013.01); *F01N 13/1894* (2013.01); *F01N 1/089* (2013.01); *F01N 13/1888* (2013.01); *F01N 2260/18* (2013.01); *F01N 2450/20* (2013.01); *F01N 2470/02* (2013.01); *F01N 2470/06* (2013.01);
(Continued)

(58) Field of Classification Search
CPC ..... F01N 13/1872; F01N 13/185; F01N 2260/18; F01N 2450/20; F01N 2470/18; F01N 1/023; F01N 1/026; F01N 1/02; F01N 1/08; F01N 1/089; F01N 2490/08
See application file for complete search history.

(56) References Cited

U.S. PATENT DOCUMENTS 4,111,278 A 9/1978 Bergman
4,132,286 A 1/1979 Hasui et al.
(Continued)

FOREIGN PATENT DOCUMENTS

CN 1637239 A 7/2005
CN 101078362 A 11/2007
(Continued)

*Primary Examiner* — Edgardo San Martin
(74) *Attorney, Agent, or Firm* — McGlew and Tuttle, P.C.

(57) ABSTRACT

A silencer insert (10) for a silencer of an exhaust system includes a first and a second partition wall (11, 12) and a connecting wall (13) arranged therebetween. The first partition wall (11) defines a first plane (E1), the second partition wall (12) defines a second plane (E2), and the connecting wall (13) defines a third plane (E3). At least one of the first partition wall, the second partition wall, and the connecting wall includes at least one perforated area (15). The connecting wall (13) is formed in one piece with the first partition wall (11) and the second partition wall (12). The first plane encloses with the second plane an angle of not more than 60°, the first plane and the second plane being particularly in parallel. A silencer is provided including a housing (1) receiving the silencer insert (10). A method is provided for manufacturing the silencer insert.

13 Claims, 13 Drawing Sheets

(52) U.S. Cl.
CPC ..... *F01N 2470/14* (2013.01); *F01N 2470/18* (2013.01); *F01N 2490/08* (2013.01)

(56) References Cited

U.S. PATENT DOCUMENTS

| | | | | |
|---|---|---|---|---|
| 8,033,104 | B2 * | 10/2011 | Zhang | F01N 3/36 60/295 |
| 8,051,949 | B2 * | 11/2011 | Henke | F01N 1/08 181/251 |
| 8,205,713 | B2 * | 6/2012 | Gorke | F01N 13/1838 181/212 |
| 8,205,716 | B2 * | 6/2012 | Wirth | F01N 13/185 181/269 |
| 9,121,320 | B2 * | 9/2015 | Carr | F01N 1/084 |
| 9,551,265 | B2 * | 1/2017 | Darrell | F01N 1/083 |
| 10,787,948 | B2 * | 9/2020 | Yang | F01N 3/005 |
| 10,787,951 | B2 * | 9/2020 | Dougherty | F01N 13/1844 |
| 2002/0066619 | A1 * | 6/2002 | Collmer | F01N 1/084 181/251 |
| 2008/0196969 | A1 * | 8/2008 | Henke | F01N 1/08 181/212 |
| 2015/0053501 | A1 | 2/2015 | Carr et al. | |
| 2015/0330283 | A1 | 11/2015 | Carr et al. | |

FOREIGN PATENT DOCUMENTS

| | | | |
|---|---|---|---|
| CN | 206111305 | U | 4/2017 |
| CN | 106640274 | A | 5/2017 |
| DE | 100 60 522 | A1 | 6/2002 |
| DE | 102 43 225 | A1 | 3/2004 |
| DE | 10 2009 053429 | A1 | 9/2011 |
| DE | 10 2009 053 429 | B4 | 10/2013 |
| DE | 11 2014 003814 | T5 | 5/2016 |
| EP | 2 375 017 | A2 | 10/2011 |
| EP | 2 375 017 | B1 | 6/2017 |
| WO | 2006/131165 | A1 | 12/2006 |

* cited by examiner

D-D

Detail E

C-C

SILENCER INSERT, SILENCER COMPRISING THE SAME AND METHOD FOR MANUFACTURING A SILENCER INSERT

CROSS REFERENCE TO RELATED APPLICATIONS

The present application claims priority of Patent Application No. 10 2017 124 750.5, filed Oct. 23, 2017 in Germany, the entire contents of which are incorporated by reference herein.

TECHNICAL FIELD

The present invention relates to silencers (also known as mufflers) and more particularly relates to an insert for a silencer (hereinafter: silencer insert) of an exhaust system of an internal combustion engine as well as a silencer with such a silencer insert. The invention also concerns a method for manufacturing such a silencer insert.

BACKGROUND

Irrespective of the type of an internal combustion engine (e.g. reciprocating piston engine, pistonless rotary engine or free-piston engine), noises are generated as a result of the successively executed strokes (in particular intake and compression of a fuel-air mixture, combustion and discharge of the combusted fuel-air mixture). On the one hand, the noises pass through the internal combustion engine in the form of solid-borne sound and are emitted on the outside of the internal combustion engine in the form of airborne sound. On the other hand, the noises pass through an exhaust system in fluid connection with the internal combustion engine as airborne sound together with the combusted fuel-air mixture (hereinafter referred to as exhaust gas). In addition to the noises caused by the internal combustion engine, flow noises often also occur. The noises passing through the exhaust system are referred to as exhaust noises.

The exhaust noises which pass through the exhaust system together with the exhaust gas as airborne sound, are reduced by silencers arranged in front of a mouth of the exhaust system, the silencers being disposed downstream of catalytic converters, if present. Such silencers can, for example, operate according to the absorption and/or reflection principle, whereby resonance absorbers operating, inter alia, according to the principle of a Helmholtz resonator are used.

All types of silencers have in common that they have a housing that confines the silencer to the outside. This also prevents exhaust gas from leaving the exhaust system prematurely. Further, a silencer insert consisting, for example, of at least one partition wall and/or at least one straight or curved conduit (pipe) is usually arranged inside the housing. The partition walls divide the interior of the housing in different chambers having different throughflows to implement the silencing. The conduits inside the silencer direct the exhaust gas inside the housing to the individual chambers.

The housing and the silencer insert are often made of sheet metal, stainless sheet steel or rustproof sheet steel.

Silencers can be manufactured in different ways:

In the wound construction described in EP 2 375 017 B1 and WO 2006/131165 A1, for example, an elongated hollow body with open end faces is formed first by bending a sheet metal and closing the joint (for instance by welding, soldering or flanging). A silencer insert is then inserted into the hollow body and the end faces of the hollow body are closed (e.g. with deep-drawn sheets). Hereby, exhaust gas pipes may penetrate one or both of the end faces as well as the circumferential wall.

In the (half) shell construction described in DE 102 43 225 A1, for example, the housing of the silencer is formed by two (or more) shells that are joined together after insertion of the silencer insert (for example by welding, soldering or flanging). The shells can be provided with fittings for exhaust gas pipes.

In the following, the construction of a silencer in (half) shell construction where partition walls are interconnected in a conventional way will be briefly explained referencing FIGS. 1A and 1B.

FIG. 1A shows a lower shell 101 of the silencer with a silencer insert 110 received in the lower shell 101, an exhaust gas inlet pipe 102 penetrating the lower shell 101 and two exhaust gas outlet pipes 103 and 104 running to the outside between the lower shell 101 and the (not shown) upper shell. The lower shell 101 also accommodates a partition wall 105 separate from the silencer insert 110.

As can be seen particularly well from FIG. 1B, the silencer insert 110 is made up of three perforated and profiled partition walls 111, 112 and 113. The partition walls 111, 112 and 113 were formed separately from each other from sheet metal material first and then welded together. FIG. 1B shows two welding joints 114 connecting partition walls 111 and 113. It is emphasized that the shape of the individual partition walls 105, 111, 112 and 113 shown in FIGS. 1A and 1B is not believed to belong to the prior art.

Irrespective of the silencer's construction, one of the detriments of known silencers is that the correct positioning of the partition walls of the silencer insert is complex. A precise positioning of the partition walls is necessary, as the exhaust gas pipes often have to be inserted through the partition walls after assembly of the silencer. Although the partition walls of the silencer insert are often joined together by pipes and/or struts before they are inserted into the housing to form a silencer insert, this only shifts the workload to pre-assembly. In addition, the welding joints used are susceptible to corrosion and in particular to intergranular corrosion, since the high temperatures alter the microstructure of the materials used.

SUMMARY OF THE INVENTION

It is an object of the invention to provide a silencer insert that can be manufactured particularly easily and cost-effectively and that is exceptionally robust.

According to the invention, embodiments of a silencer insert for a silencer of an exhaust system comprise a first partition wall, a second partition wall and a connecting wall disposed between the first partition wall and the second partition wall. The first partition wall defines a first plane, the second partition wall defines a second plane, different from the first plane, and the connecting wall defines a third plane, different from both the first plane and the second plane. In an embodiment, the first partition wall and the second partition wall and the connecting wall each have a flat perimeter (i.e. a perimeter that is in a plane) that defines the respective plane. The first partition wall and/or the second partition wall and/or the connecting wall each have at least one perforated area. According to an embodiment, each partition wall has a total of between 100 and 1,000 or between 200 and 900 or between 300 and 800 or between 400 and 600 and in particular 500 holes, which define the perforated areas. According to another embodiment, the diameter of the holes in the perforated area is between 0.1 mm and 6 mm and in particular between 0.2 mm and 3 mm. According to an embodiment, the perforated area has between 1 and 50 holes or between 2 and 30 holes or between 3 and 20 holes per square centimeter. The connecting wall is made in one piece, including both the first and second partition walls, from a single piece of material. The connecting wall and the first and second partition walls are hereby arranged in such a way that the angle enclosed by first and second plane is not more than 60° or not more than 45° or not more than 30°. In particular, the first plane may be parallel to the second plane. By definition, the angle between two planes is the smallest angle between normal vectors on these planes.

With the connecting wall and the first and second partition walls made from a single piece of formed material, the manufacturing process is simplified, since the number of parts to be handled is reduced. There is no need to pre-assemble the silencer insert by welding several walls together. There is also a (certain) weight saving, since a one-piece silencer insert weighs less than a silencer insert consisting of several components joined together. Since in a one-piece silencer insert the connecting wall and the first and second partition walls are not only linked at certain points but over the entire joint area and are therefore connected with each other over the entire joint area, the silencer insert obtained is more rigid than a silencer insert in which the individual components are only joined to each other at certain points. Furthermore, with a one-piece silencer insert, the probability of intergranular corrosion is reduced because there are no welding seams. Finally, the elimination of welding seams also allows the silencer insert to be manufactured as a whole from less expensive alloys and, in particular, alloys that are difficult to weld, since no weldability is required.

According to an embodiment, the angle enclosed between the third plane and the first and/or second plane is between 20° and 90°. According to an embodiment, the angle between the third plane and the first and/or second plane is between 40° and 90°. According to an embodiment, the angle between the third plane and the first and/or second plane is between 60° and 90°. Respective angles allow the first and second partition wall to be arranged in parallel.

According to an embodiment, at least one of the first partition wall, the second partition wall, and the connecting wall comprises a rim portion along the part of its perimeter not connected to another wall that is folded between 70° and 110° relative to the corresponding plane. According to an embodiment, at least one of the first partition wall, the second partition wall, and the connecting wall comprises a rim portion along the part of its circumference not connected to another wall that is folded between 80° and 100° relative to the corresponding plane. According to an embodiment, at least one of the first partition wall, the second partition wall, and the connecting wall comprises a rim portion along the part of its circumference not connected to another wall that is folded perpendicularly with respect to the corresponding plane. The folded rim portion is configured as abutting face for a housing of a silencer. A respective fold of the rim portion is also referred to as "rim canting". A respective measure not only increases the contact surface for a housing of a silencer, but also results in a significant increase of the respective wall's stiffness.

According to an embodiment, at least one of the first partition wall, the second partition wall, and the connecting wall, comprises a coupling portion along the part of its circumference not connected to another wall, where the wall includes a protrusion and/or recession along its circumferential direction configured for engaging a coupling portion of a housing of a silencer. According to an embodiment, the sign of curvature of the perimeter of the respective wall changes along the circumferential direction at a protrusion or recession at least twice within a distance of less than 5 cm measured along the perimeter. Such a coupling portion allows a reliable positioning of the silencer insert into the housing of a silencer without requiring a further fixing by welding or the like. Said coupling portion further serves to improve the stiffness of the entire structure of a silencer receiving the silencer insert, thereby reducing the vibrations of a housing of the silencer.

According to an embodiment, at least one of the first partition wall, the second partition wall, and the connecting wall comprises at least one elevated stiffening portion defining a plane parallel to the plane defined by the respective wall and spaced from that wall by at least the double of the wall thickness of the respective wall. In this manner, the respective walls may comprise a plateau increasing the stiffness of the respective wall. According to an embodiment, the plane defined by the elevated stiffening portion is spaced from the plane defined by the respective wall by not more than a hundred times the wall thickness or not more than fifty times the wall thickness or not more than twenty times the wall thickness.

According to an embodiment, at least one of the first partition wall, the second partition wall, and the connecting wall comprises at least one through hole for an exhaust gas pipe. In this manner, the silencer insert may serve to seat exhaust gas pipes inside the silencer.

According to an embodiment, the first and second partition wall as well as the connecting wall are made of sheet metal, sheet steel, stainless sheet steel, and in particular, rustproof sheet steel.

Apart from a housing, embodiments of a silencer comprise a silencer insert as described above received in the housing.

According to an embodiment, a coupling portion having the shape of a bead or of a protrusion is formed into the housing and the coupling portion of the housing engages a coupling portion provided at a silencer insert.

According to an embodiment, the shape of the coupling portion of the housing is complementary to the shape of the coupling portion of the silencer insert.

According to an embodiment, the silencer comprises at least one exhaust gas pipe passing through the housing and passing through a through hole provided in the silencer insert. Next to the through hole, the exhaust gas pipe may further comprise a portion where the (outer) diameter of the exhaust gas pipe increases relative to the diameter of the silencer insert's through hole or where a wall portion of the exhaust gas pipe is pressed radially outwards as described in WO 2006/131165 A1. According to an embodiment, the exhaust gas pipe may comprise a respective region on both sides of the through hole where the outer diameter is increased with respect to the diameter of the through hole or where a wall portion of the exhaust gas is pressed radially outwards.

Embodiments of a method for making a silencer insert as described above comprise the following steps: providing a sheet metal strip; perforating the sheet metal strip to form at least one perforated area; cutting portions of the sheet metal strip to size to form pairs of partition walls of the silencer insert which are each spaced by a connecting wall; bending the portions of the sheet metal strip forming the partition walls of the silencer insert with respect to the portion of the sheet metal strip forming the connecting wall of the silencer insert by between 20° and 160°, or by between 40° and 140°, or by between 60° and 120°, or by between 80° and 100° and particularly by 90° (a respective bending can be implemented in several steps and along two bending edges; for achieving a desired angle, an overbending can be applied to count for a spring-back characteristic of the sheet metal material); providing at least one through hole for the exhaust gas pipe in at least one of the partition wall or connecting wall of the silencer insert; and cutting the connecting wall to size.

This method enables a provision of a one-piece silencer insert without the need to connect several individual parts.

According to an embodiment, cutting of the partition walls and/or the connecting walls to size takes place in several steps, with a rough pre-cutting/clearance-cutting done first and a precise cutting of the desired contour done afterwards.

According to an embodiment, several silencer inserts are formed simultaneously from one sheet metal strip with the several silencer inserts being joined by their connecting walls until being cut clear or cut to size. Thus, there is a strip connection between the connecting walls of the silencer inserts to be made. A respective strip connection allows the manufacturing costs to be reduced, since less parts have to be handled and positioned.

According to an embodiment, the method comprises, after the step for providing the sheet metal strip and before the step for cutting the portions of the sheet metal strip forming the partition walls of the silencer insert to size, additionally the following step: deep-drawing the sheet metal strip to form at least one elevated stiffening portion. Since this step is carried out before the sheet metal strip forming the partition walls of the silence insert is cut to size, said step can be carried out simultaneously for several silencer inserts to be made from the sheet metal strip.

According to an embodiment, the method comprises after the step for cutting the portions of the sheet metal strip forming the partition walls of the silencer insert to size additionally the following step: folding of rim portions of the portions of the sheet metal strip forming the partition walls of the silencer insert by between 70° and 110° or by between 80° and 100° and particularly by 90° (said folding can be implemented in several steps). In this manner, the stability of the portions forming the partition walls increases and an abutting face for a housing of a silencer is achieved.

According to an embodiment, the method comprises after the step for providing at least one through hole for an exhaust gas pipe in at least one partition wall of the silencer insert and before the step for cutting the connecting wall an additional step for providing at least one through hole for an exhaust gas pipe in the connecting wall of the silencer insert. According to an embodiment, said at least one through hole is provided wedge-acting, which means that the rim portion of the hole is funnel-shaped or flared up. This increases the abutting area for the exhaust gas pipe and facilitates passing the exhaust gas pipe through the through hole.

According to an embodiment, the method comprises, after the step of cutting the connecting wall to size, additionally a step for folding rim portions of the portion of the sheet metal strip forming the connecting wall of the silencer insert by between 70° and 110° or by between 80° and 100° and particularly by 90°. This increases the stiffness of the connecting wall and increases the abutting area for a housing of a silencer.

The forgoing as well as other advantageous features of the disclosure will be more apparent from the following detailed description of exemplary embodiments with reference to the accompanying drawings. It is noted that not all possible embodiments necessarily exhibit each and every, or any, of the advantages identified herein.

In the following embodiments of the invention are explained in more detail with reference to Figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3B is a perspective view of the silencer insert of FIG. 3A with an exhaust gas pipe passed through;

DESCRIPTION OF PREFERRED EMBODIMENTS

Figure 1A:
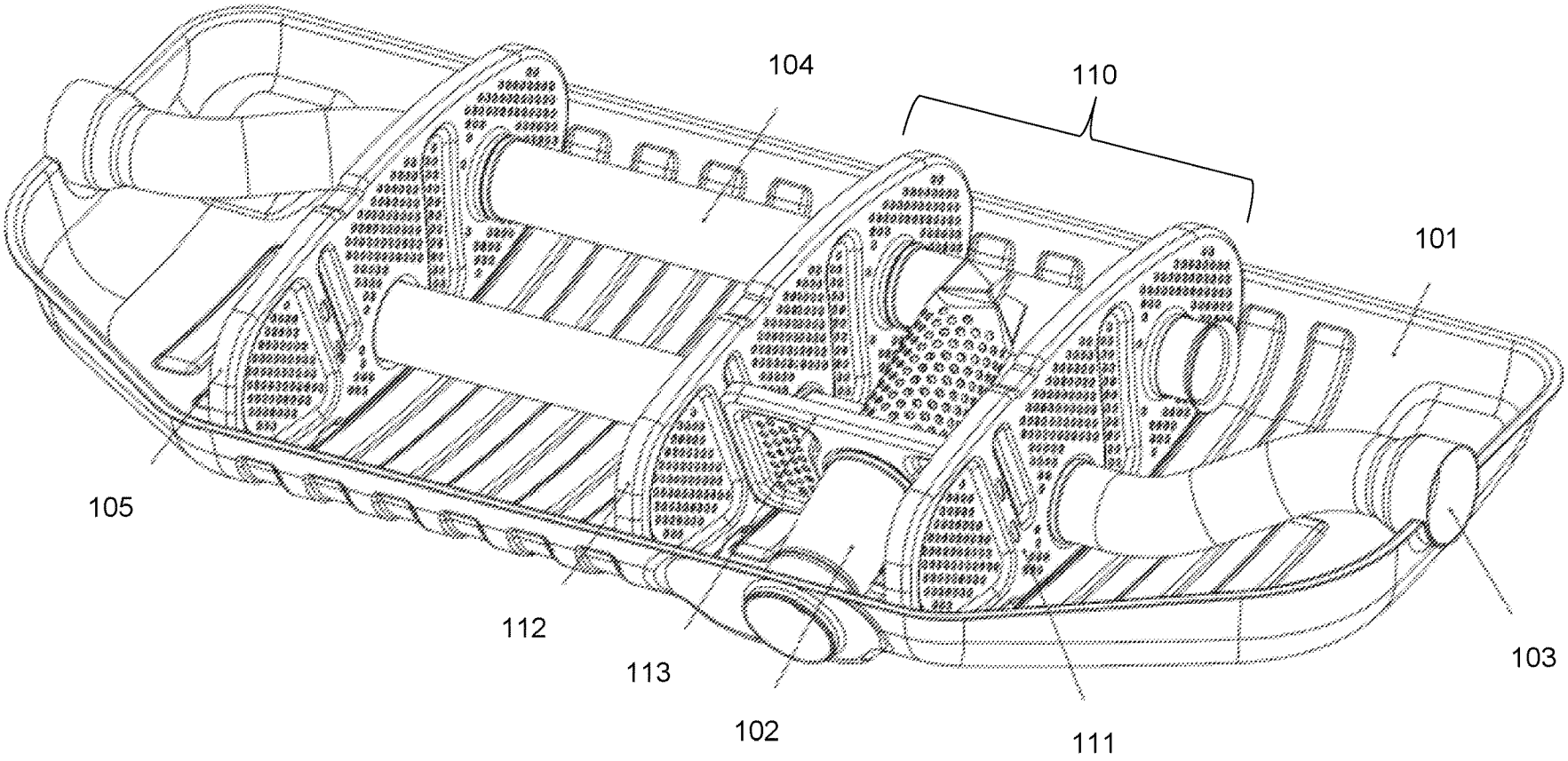
FIG. 1A is a perspective view of a silencer in (half) shell construction with the upper shell of the silencer not being illustrated.
Figure 1B:
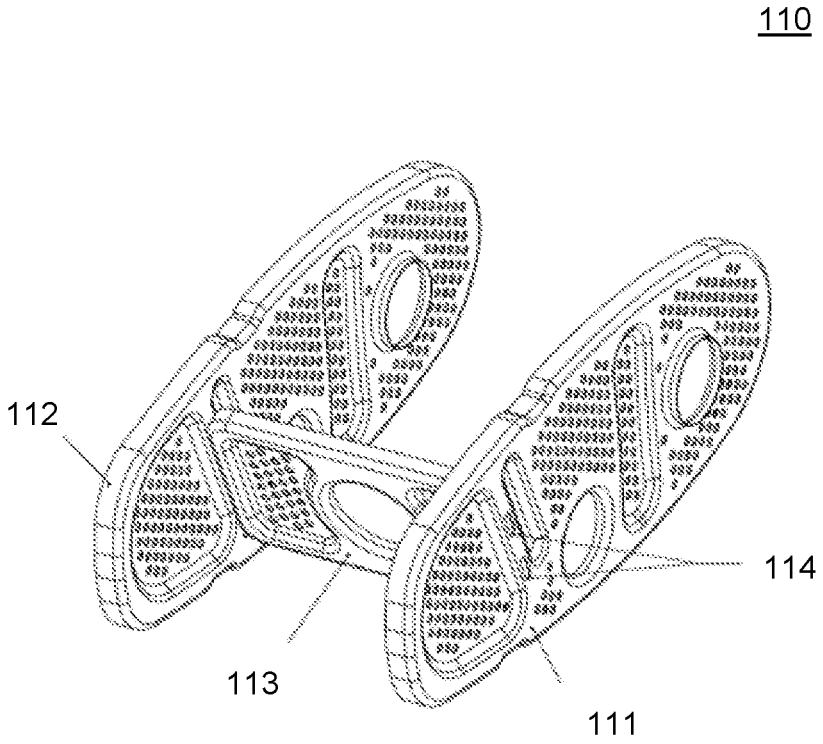
FIG. 1B is a perspective view of a silencer insert of the silencer of FIG. 1A.

Referring to the drawings, in the exemplary embodiments described below, components that are alike in function and structure are designated as far as possible by alike reference numerals. Therefore, to understand the features of the individual components of a specific embodiment, the description of other embodiments and of the summary of the disclosure should be referred to.

In the following, a description of an embodiment of a silencer according to an embodiment is given with reference to FIGS. 2, 3, and 4.

Figure 2:
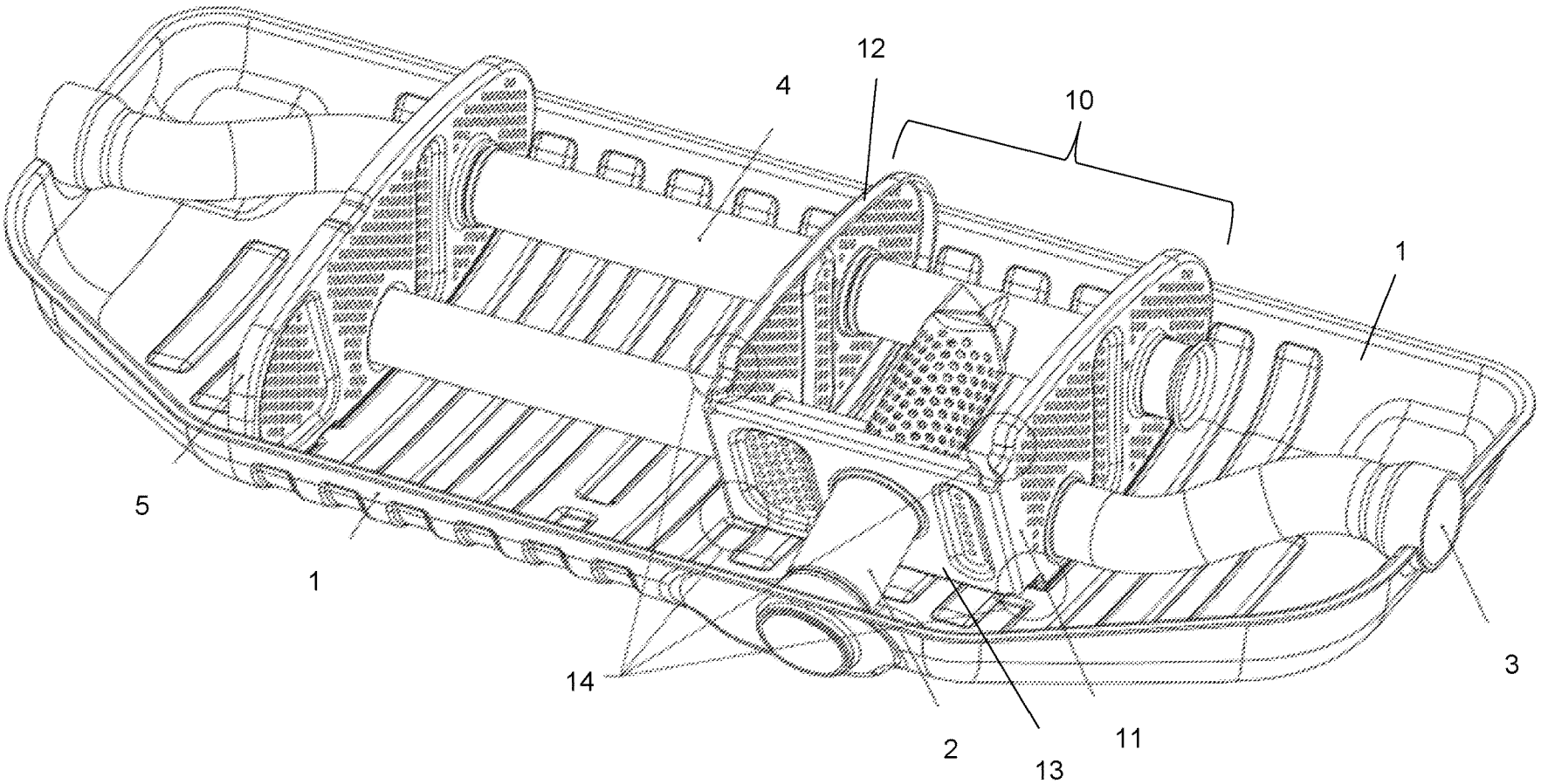
FIG. 2 is a perspective view of a silencer according to an embodiment with the upper shell of the silencer not being illustrated.

FIG. 2 hereby illustrates a lower shell 1 of the silencer made from a stainless steel sheet by deep drawing and receiving a separate partition wall 5 and a silencer insert 10, both also made from a stainless steel sheet by deep drawing. The separate partition wall 5 and the silencer insert 10 are thereby disposed in depressions embossed into the lower shell 1 of the silencer housing. For the sake of clarity, the upper shell of the silencer housing is not shown, its shape is, however, basically mirror-symmetrical to the shape of the lower shell 1.

In the mounted state shown in FIG. 2, an exhaust gas pipe 2 penetrates a connection wall 13 of the silencer insert 10, which is arranged between a first partition wall 11 and a second partition wall 12, the exhaust gas pipe further penetrating the lower shell 1 of the silencer housing and leading into a space defined between the first partition wall 11, the second partition wall 12, and the connecting wall 13. The first and second partition walls 11 and 12 and the connecting wall 13 arranged between the two partition walls 11 and 12 are made in one piece from a stainless steel sheet. Further, two exhaust gas outlet pipes 3 and 4 penetrating the first and second partition walls 11 and 12 as well as the separate partition wall 5 are led out at opposite ends of the silencer housing between its lower shell 1 and the upper shell.

Figure 3A:
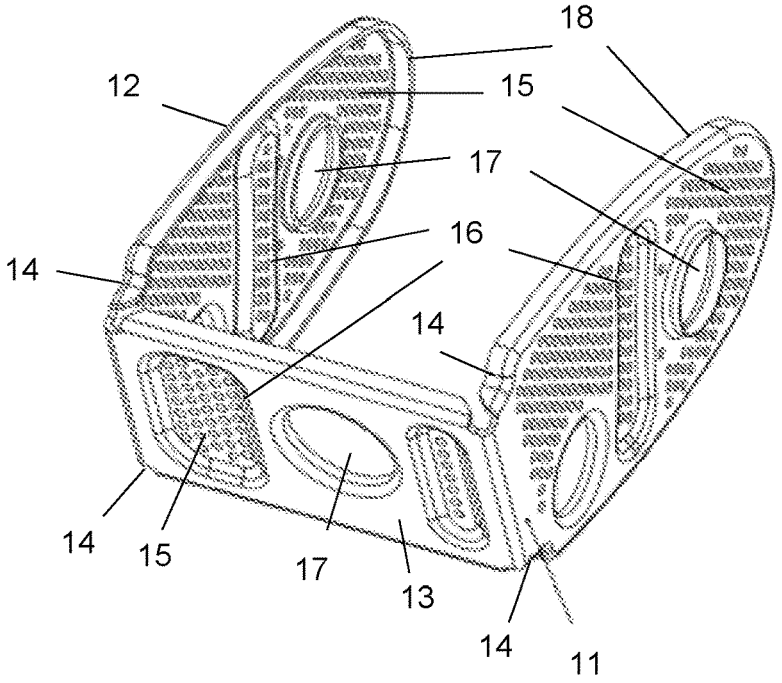
FIG. 3A is a perspective view of a silencer insert of the silencer of FIG. 2.
Figure 3B:
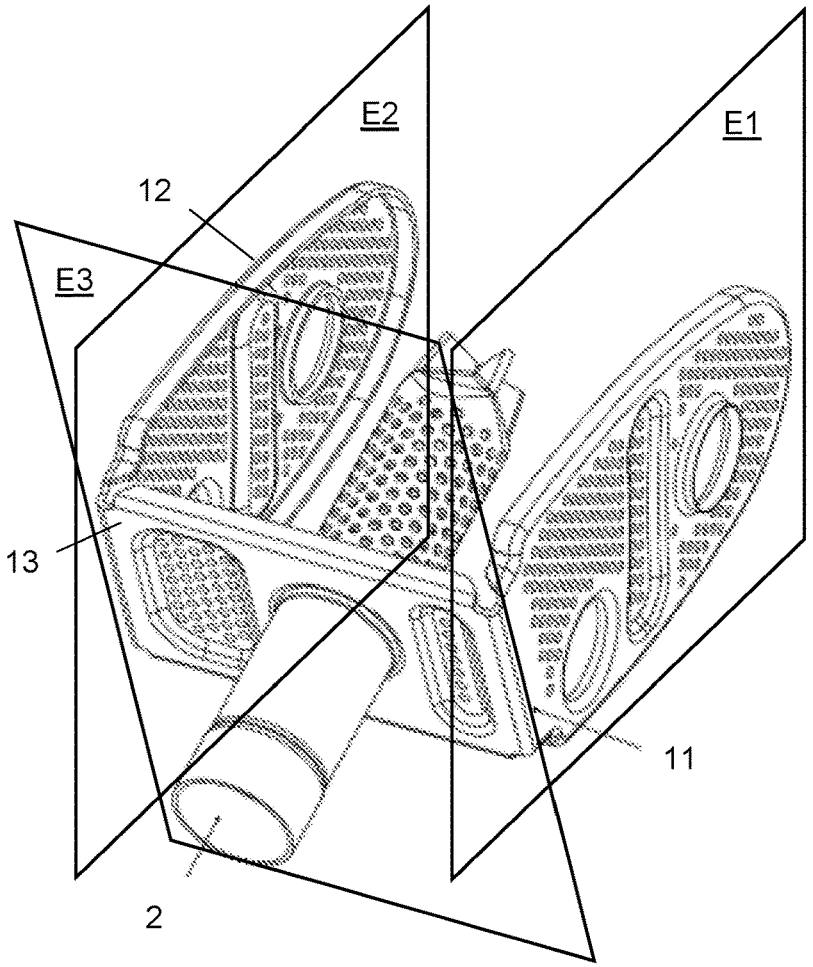

The structure of the silencer insert 10 can be seen particularly well in FIGS. 3A and 3B. FIG. 3A thereby shows the silencer insert 10 by itself and FIG. 3B shows the silencer insert 10 with the exhaust inlet pipe 2 held by the silencer insert 10.

Referencing FIG. 3B, the first partition wall 11 defines a first plane E1, the second partition wall 12 defines a second plane E2, and the connecting wall 13 defines a third plane E3. The first and second planes E1 and E2 are thereby perpendicular to the third plane E3 forming an angle of 90° with said third plane E3. Further, in the embodiment shown, the two planes E1 and E2 are parallel to one another.

As can be seen particularly well in FIG. 3A, each of the first and second partition walls 11 and 12 as well as the connecting wall 13 comprise several (each of the partition walls four and the connecting wall two) perforated areas 15. Each of the partition walls 11 and 12 has a total of approximately 500 holes formed therein. The connecting wall 13 has 8 holes formed therein that, however, have a significantly bigger diameter than the holes in the partition walls 11 and 12.

Further, the first and second partition walls 11 and 12 each have an elevated stiffening portion 16. The connecting wall 13 is provided with two elevated stiffening portions 16. The elevated stiffening portions thereby define two respective planes which, in the illustrated embodiment, are spaced five times the wall thickness of the respective wall 11, 12, 13 from the plane E1, E2 or E3 defined by the respective wall 11, 12, 13.

In the connecting wall 13 a through hole 17 is provided for the exhaust gas inlet pipe 2 configured to have a funnel-like cross section and being flared up. In each of the first and second partition walls 11 and 12 two through holes are provided for the exhaust gas outlet pipes 3 and 4 that are also shaped to have a funnel-like cross section and being flared up.

At the part of their perimeter not connected to another wall, the first and second partition walls 11 and 12 as well as the connecting wall 13 each have a rim portion 18 folded perpendicularly with respect to the plane E1, E2, or E3 defined by the respective wall thereby being available as abutting face for the lower shell or the upper shell of the silencer as shown in FIG. 2.

Further, the first and second partition walls 11 and 12 comprise near their joint to the connecting wall 13, on each of two opposite sides, two coupling portions 14 adapted to engage with corresponding coupling portions formed at the lower shell 1 and the upper shell of the silencer. This will be explained below in more detail referencing FIGS. 4, 4A, 4B, and 4C.

Figure 4:
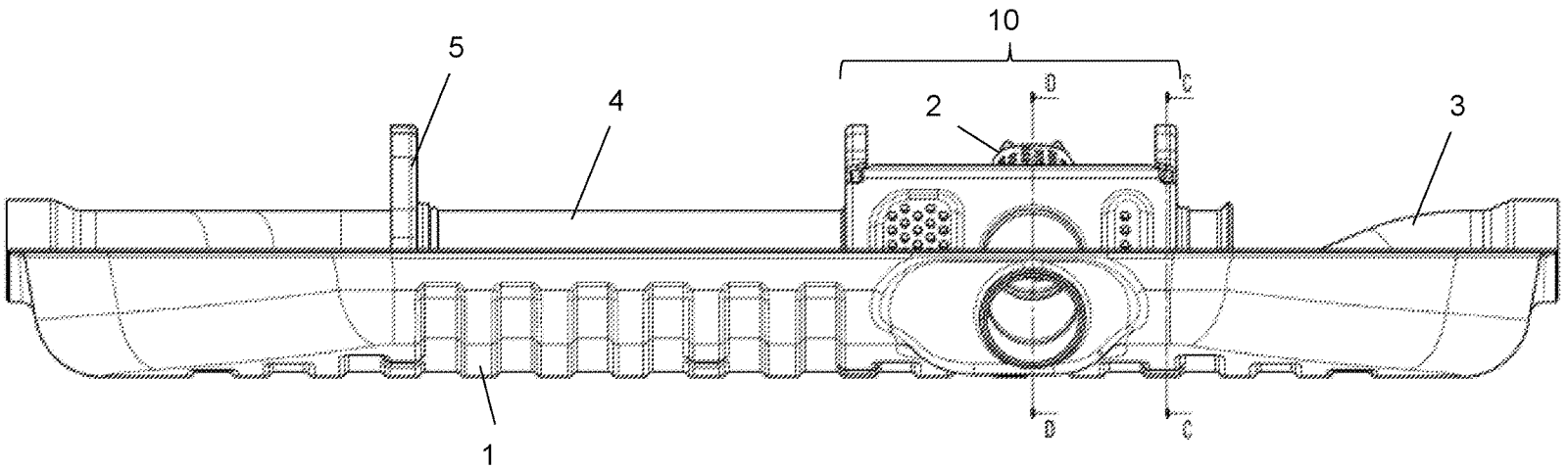
FIG. 4 is a side view of the silencer of FIG. 2.
Figure 4B:
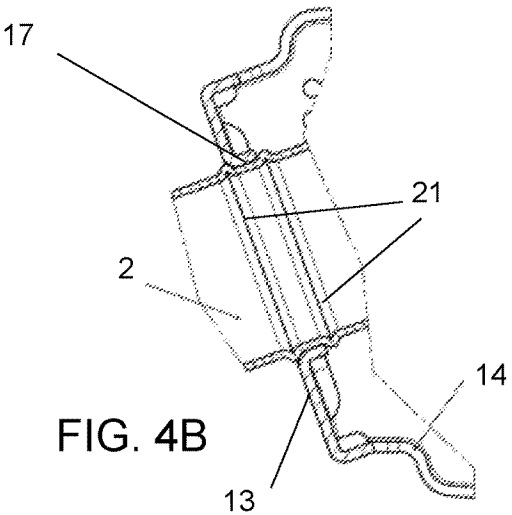
FIG. 4B is a sectional view through sectional line D-D of the silencer of FIG. 4.
Figure 4C:
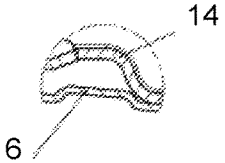
FIG. 4C is a detail view showing a detail E from FIG. 4A.
Figure 4A:
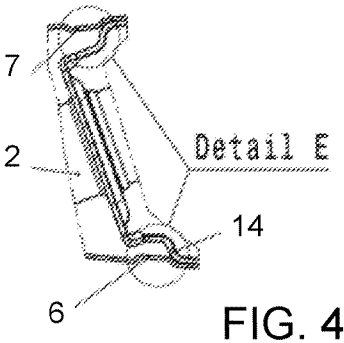
FIG. 4A is a sectional view through sectional line C-C of the silencer of FIG. 4.

FIG. 4A thereby shows a cross section through the silencer of FIG. 4 along sectional line C-C, and FIG. 4C shows detail E of FIG. 4A.

Referencing FIG. 4A, the lower shell 1 and the upper shell of the silencer each comprise coupling portions 6 and 7 formed as protrusions protruding into the direction of the interior of the silencer housing. Said protrusions cooperate with coupling portions 14 formed as recessions at the first and second partition walls 11 and 12 thereby preventing movement of the silencer insert 10 in the direction of the exhaust gas inlet pipe 2.

From FIG. 4B showing a cross section through the silencer of FIG. 4 along sectional line D-D, it can be seen how the exhaust gas inlet pipe 2 can be supported in the through hole 17 of the connecting wall 13. In the embodiment shown, the exhaust gas inlet pipe 2 has been re-shaped after passing it through the through hole 17 from its interior such that it comprises a portion 21 on each side of the through hole 17 where the outer diameter of the exhaust gas inlet pipe 2 is increased. In this manner, an axial movement of the exhaust gas inlet pipe 2 relative to the connecting wall 13 can be prevented.

In the following, a method for manufacturing a silencer insert according to the above embodiment will be described referencing FIGS. 5A to 5J. The silencer insert described is thereby quite similar to the silencer insert described above, it is, however, not completely identical to the silencer insert described above.

Figure 5A:
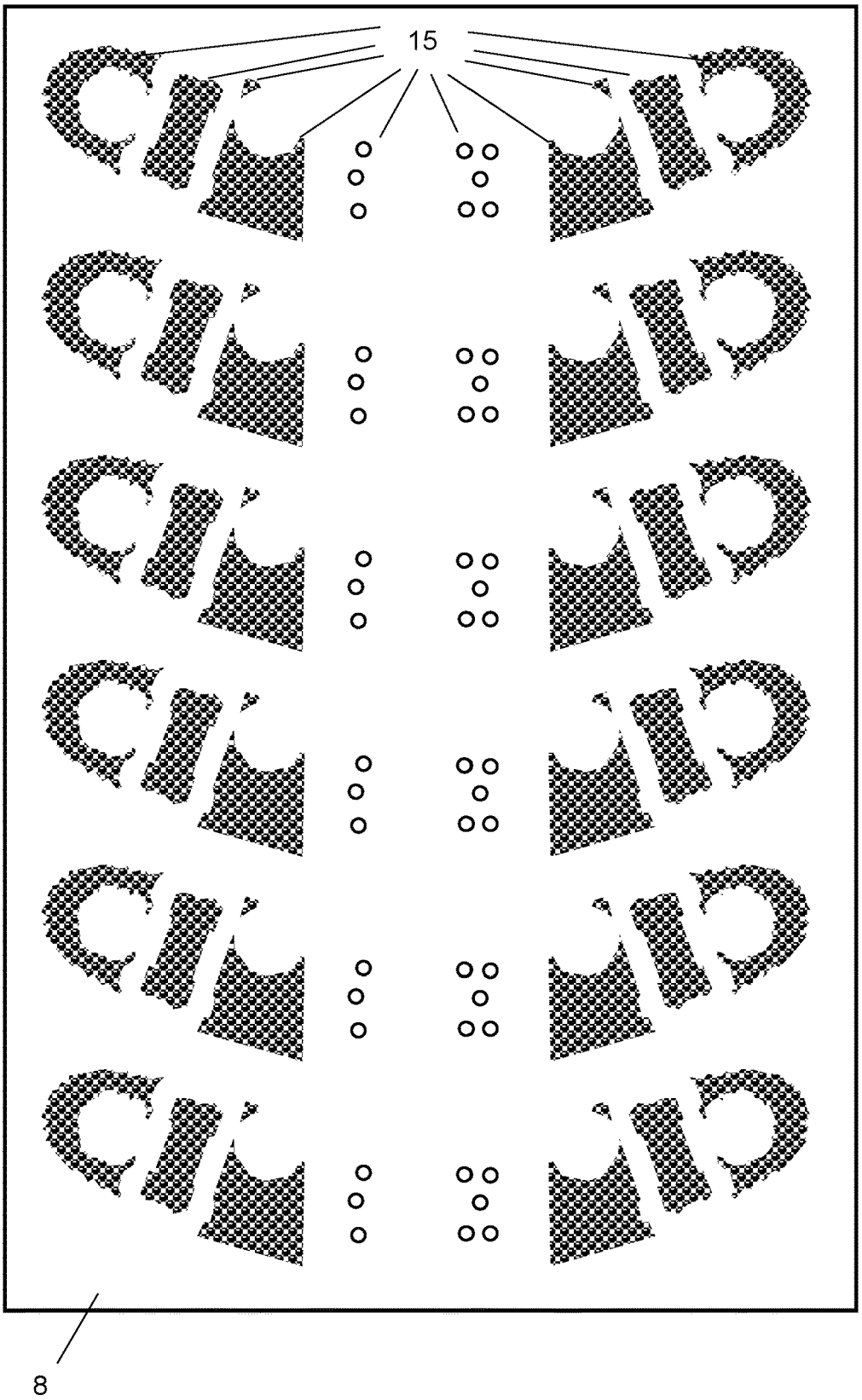
FIG. 5A is a top view of a sheet metal strip, from which several silencer inserts are made simultaneously, illustrating one of different machining states of the sheet metal strip.

As shown schematically in FIG. 5A, areas of a sheet metal strip provided in the form of a stainless steel sheet 8 are perforated in a first step. In the embodiment shown, six silencer inserts are made from the stainless steel sheet 8 simultaneously. In FIG. 5A, these six silencer inserts are arranged above each other from bottom to top of the Figure.

Then, the areas of the stainless steel sheet 8 forming the first and second partition walls of the silencer insert are cut free. The respective cutting edges 81 are shown in FIG. 5B.

Figure 5B:
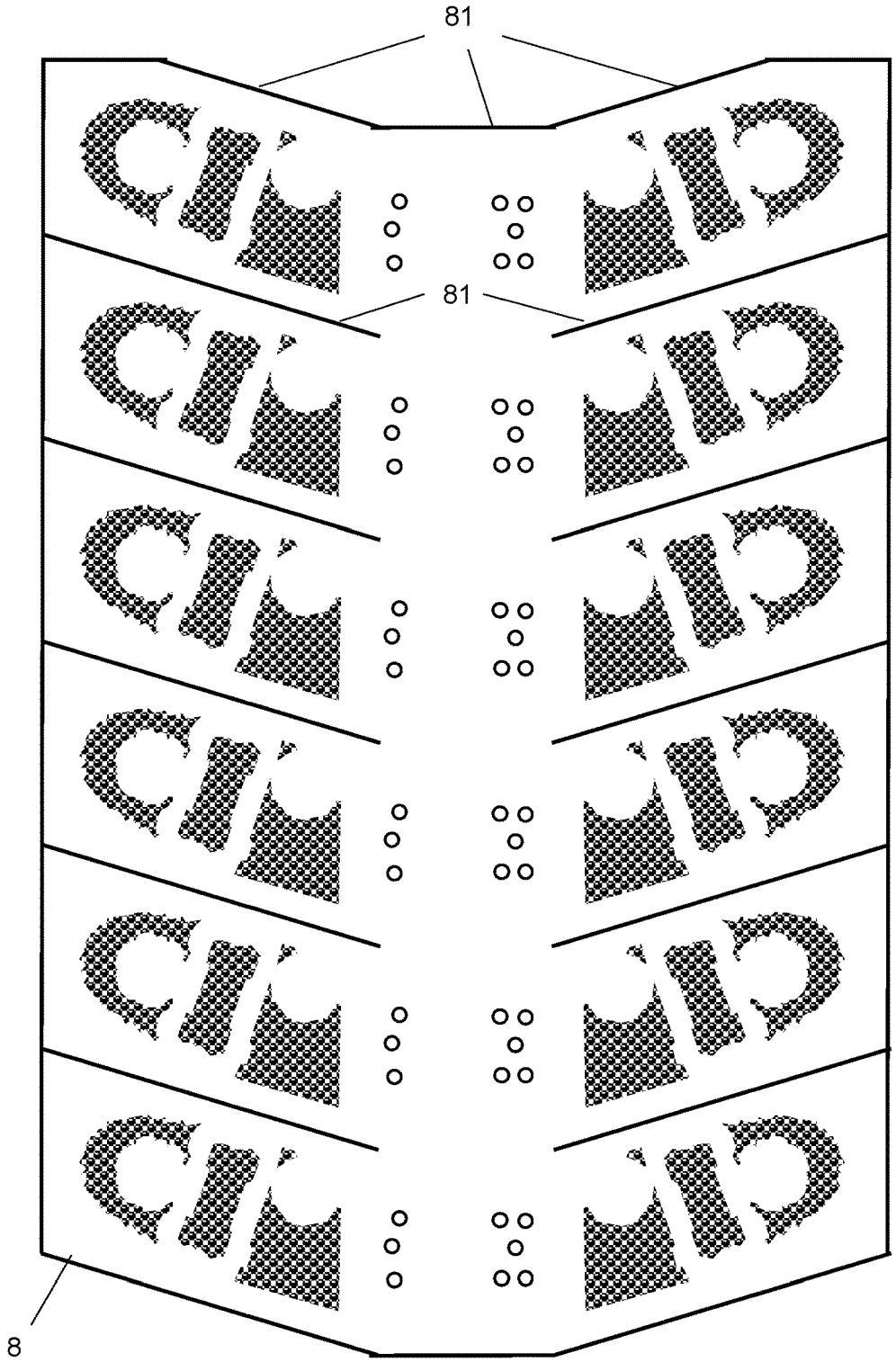
FIG. 5B is a top view of a sheet metal strip, from which several silencer inserts are made simultaneously, illustrating another of different machining states of the sheet metal strip.

As can be seen from FIG. 5B, the silencer inserts to be formed are, however, still connected along a central strip.

Figure 5C:
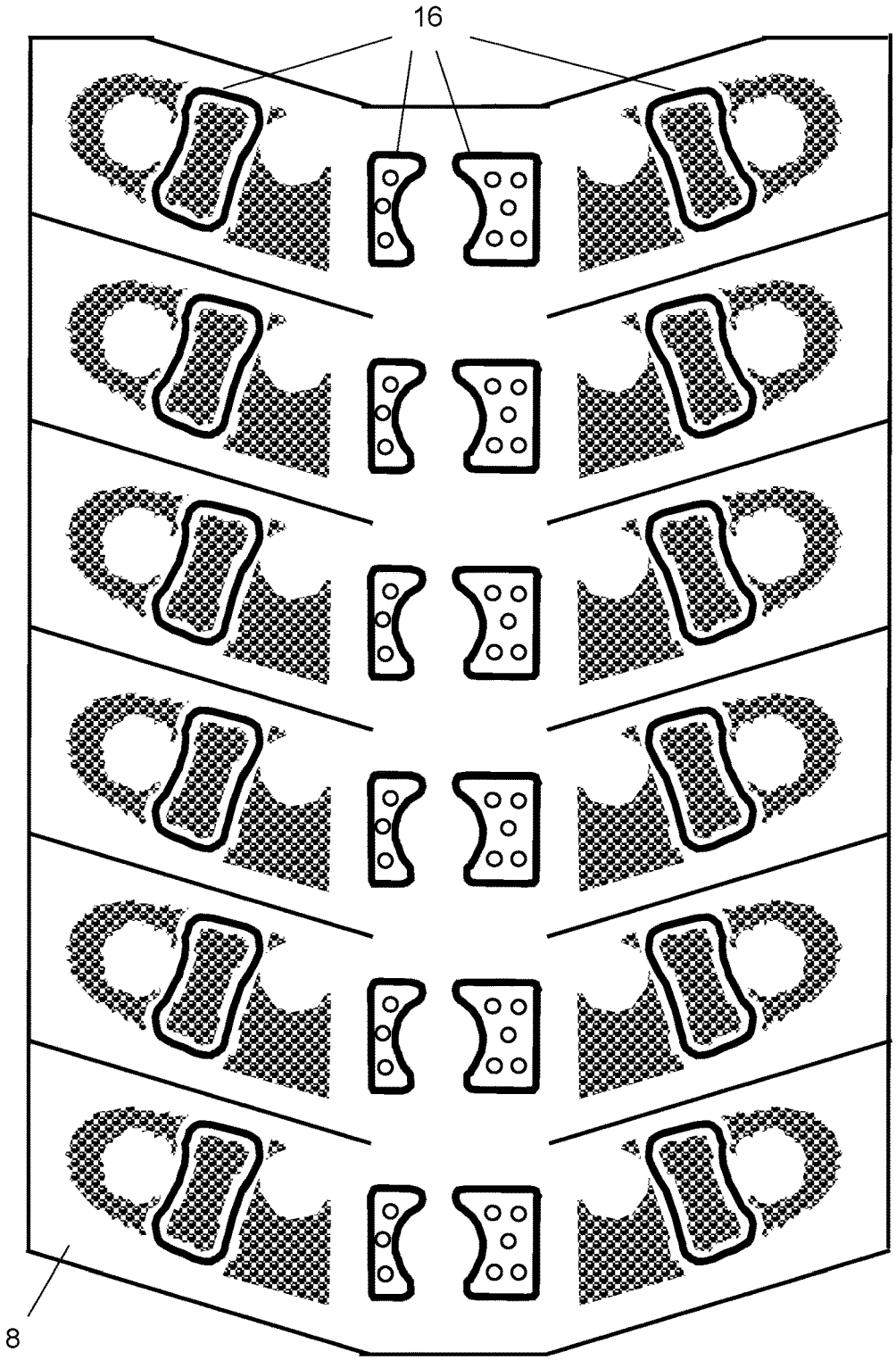
FIG. 5C is a top view of a sheet metal strip, from which several silencer inserts are made simultaneously, illustrating another of different machining states of the sheet metal strip.

Then, the elevated stiffening portions 16 shown schematically in FIG. 5C are embossed by deep-drawing the stainless steel sheet 8.

Figure 5D:
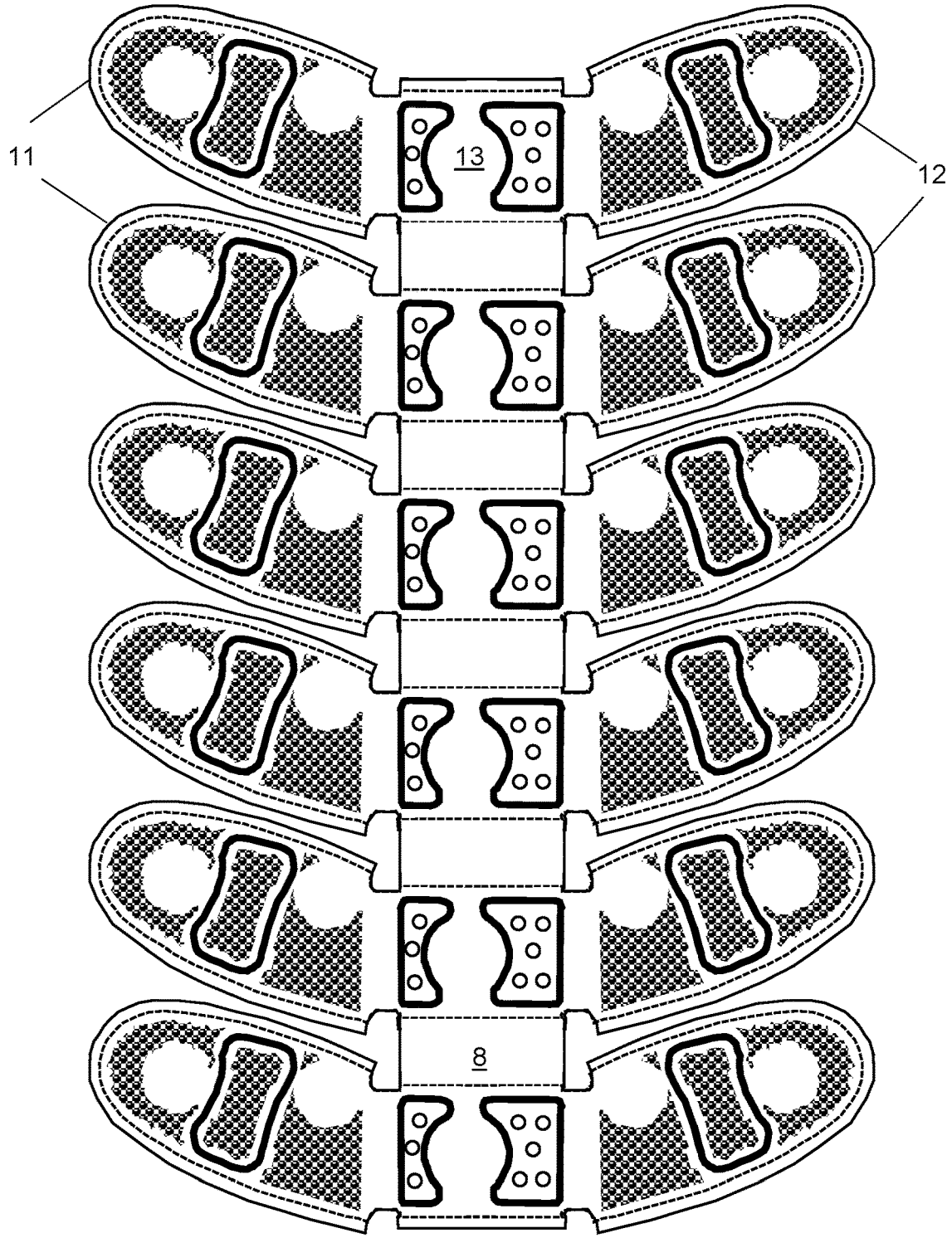
FIG. 5D is a top view of a sheet metal strip, from which several silencer inserts are made simultaneously, illustrating another of different machining states of the sheet metal strip.

After this, the stainless steel sheet 8 is cut to size in the step shown in FIG. 5D for forming the pairs of first and second partition walls 11 and 12 that are each joined by a connecting wall 13.

Figure 5E:
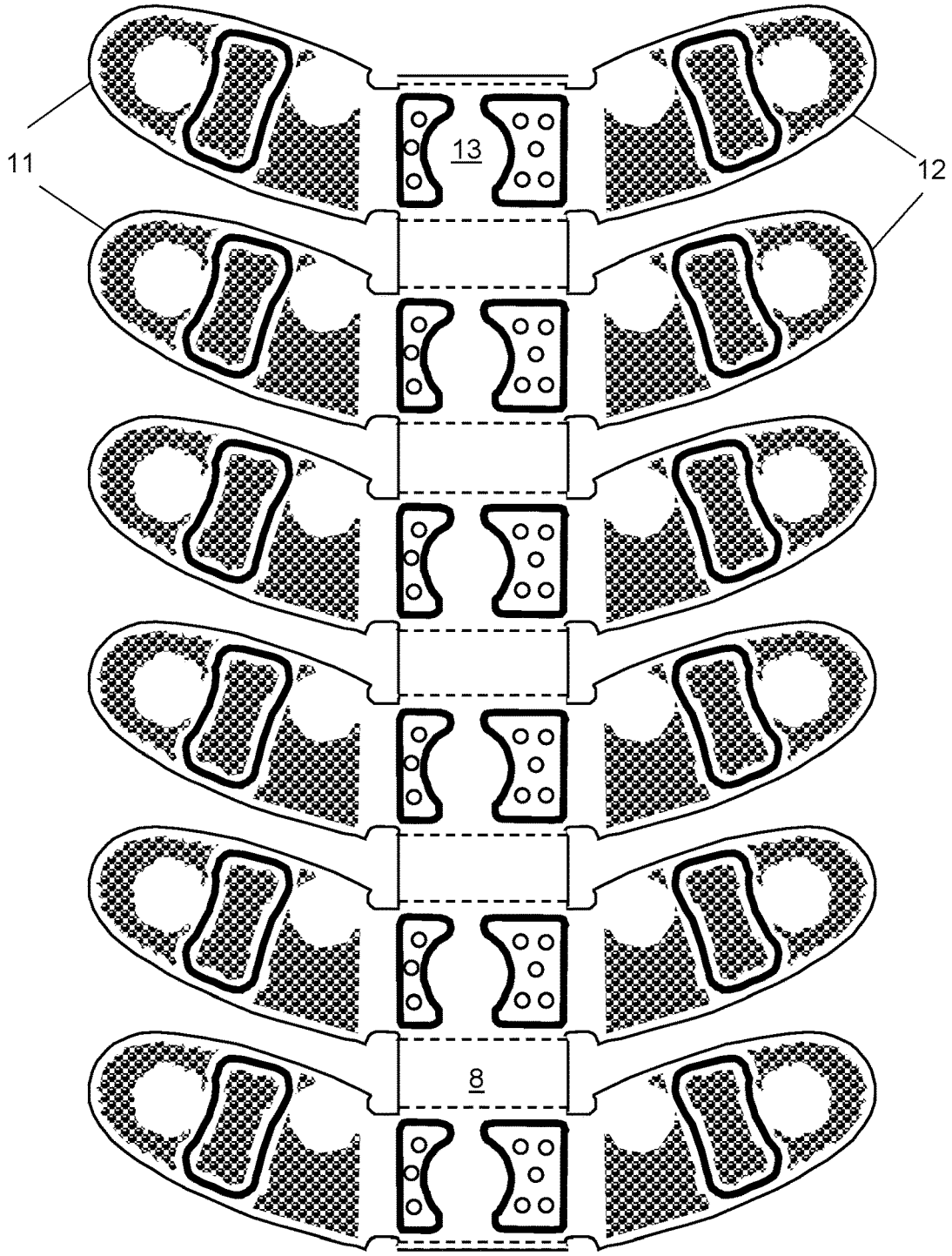
FIG. 5E is a top view of a sheet metal strip, from which several silencer inserts are made simultaneously, illustrating another of different machining states of the sheet metal strip.

Dashed lines are thereby illustrated in FIG. 5D, along which rim portions of the first and second partition walls are folded perpendicularly in the subsequent step shown in FIG. 5E. The rim portions of the connecting walls 13 are, however, not yet folded, since the connecting walls 13 of the six silencer inserts are still connected to allow for a joint handling of the silencer inserts. Accordingly, edges along which a rim portion of the connecting walls 13 will be folded at a later stage are still shown dashed in FIG. 5E.

Figure 5F:
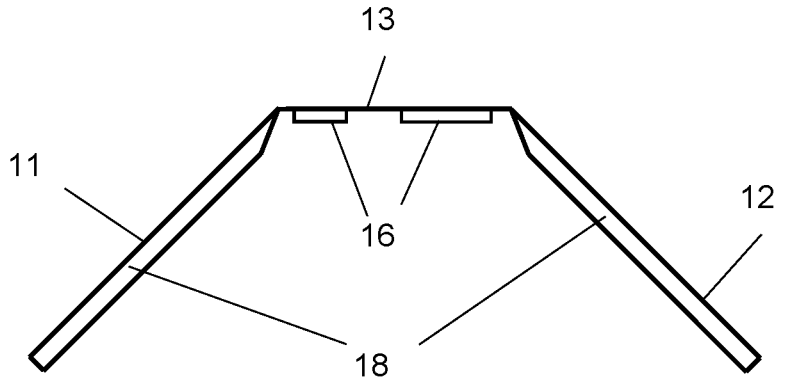
FIG. 5F is a front view of the sheet metals strip, from which several silencer inserts are made simultaneously, illustrating one of different machining states of the sheet metal strip.
Figure 5G:
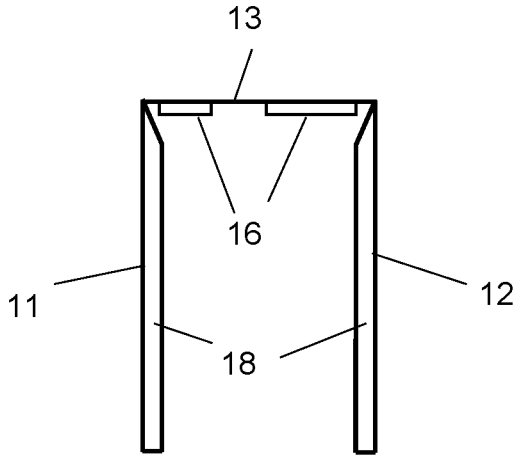
FIG. 5G is a front view of the sheet metals strip, from which several silencer inserts are made simultaneously, illustrating another of different machining states of the sheet metal strip.

Before that however, the first and second partition walls 11 and 12 are folded relative to the connecting wall 13 in several steps such that each of them is perpendicular to the connecting wall 13. This is shown in FIGS. 5F and 5G representing front views of the stainless steel sheet 8 (front view means a view from the bottom towards the top of the page showing FIG. 5A; the stainless steel sheet 8 is however in a machining state different from the machining state in FIG. 5A). This front view shows the elevated stiffening portions 16 in the connecting wall 13 while the folded rim portions 18 obscure the elevated stiffening portions in the first and second partition walls 11 and 12.

Figure 5H:
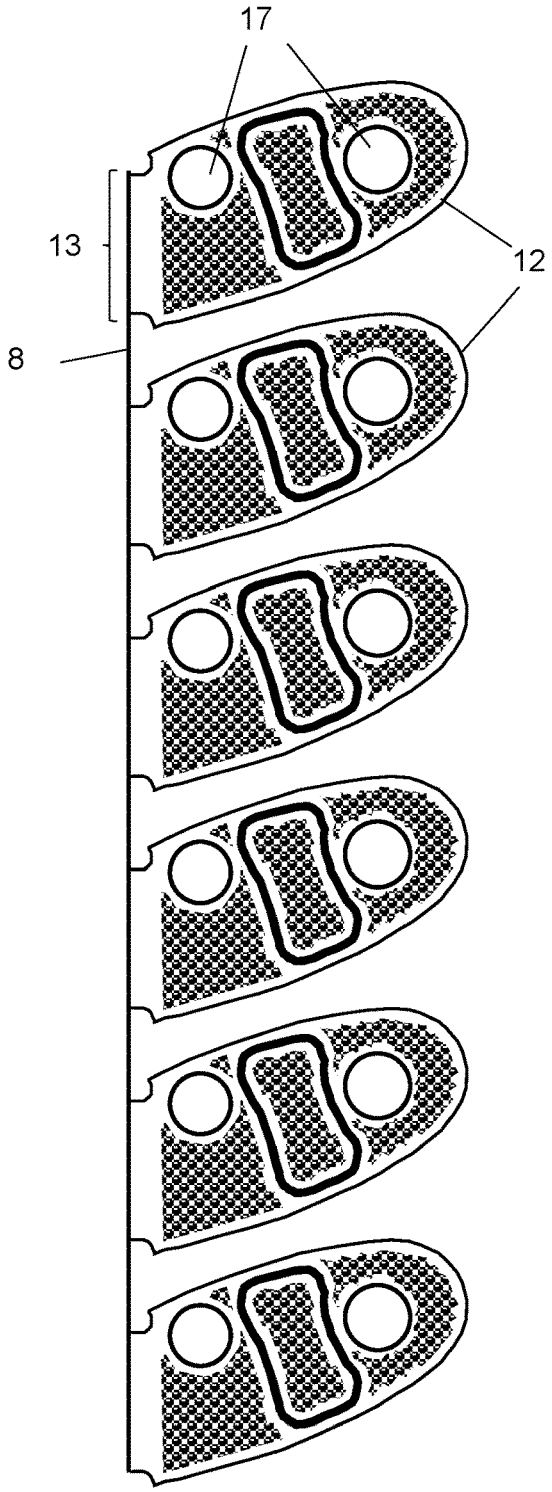
FIG. 5H is a left side view of the sheet metal strip from which several silencer inserts are made simultaneously, illustrating one of different machining states of the sheet metal strip.

Then, the through holes for the exhaust gas pipes are provided in the first and second partition walls 11 and 12 as well as in the connection wall 13. This is schematically shown in FIG. 5H showing a left side view (left side view means a view from the left towards the right of the page showing FIG. 5A; the stainless steel sheet 8 is however in a machining state different from the machining state in FIG. 5A). The through holes are thereby provided such that the rim portion is flared up, thus facilitating insertion of the exhaust gas pipes and also increasing the contact areas with the exhaust gas pipes.

Figure 5I:
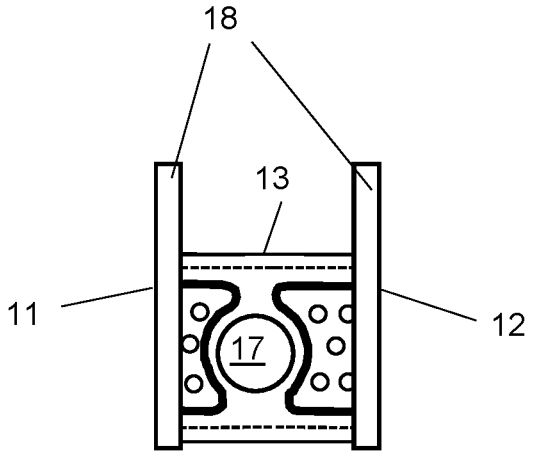
FIG. 5I is a rear view of the sheet metal strip from which several silencer inserts are made simultaneously, illustrating another, different machining state of the sheet metal strip.
Figure 5J:
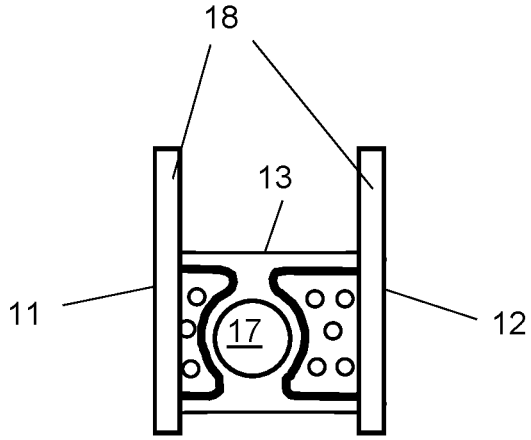
FIG. 5J is a rear view of the sheet metal strip from which several silencer inserts are made simultaneously, illustrating another, different machining state of the sheet metal strip.

Then also the connecting walls 13 are cut to size and the silencer inserts are separated. FIGS. 5I and 5J therefore show only one single silencer insert. In a last step also rim portions of the connecting wall 13 are folded perpendicular with respect to the connecting wall 13, as is obvious from a synopsis of FIGS. 5I and 5J, to thereby stiffen the connecting wall 13.

Although a silencer insert with two partition walls and one connecting wall has been described above, the present invention is not limited thereto. The silencer insert may for instance also comprise more than two partition walls with connecting walls arranged therebetween in pairs.

Although a silencer insert has been described above in the context of a silencer in (half) shell construction, the silencer insert may alternatively also be used in a silencer of wound construction.

While the disclosure has been described with respect to certain exemplary embodiments thereof, it is evident that many alternatives, modifications and variations will be apparent to those skilled in the art. Accordingly, the exemplary embodiments of the disclosure set forth herein are intended to be illustrative and not limiting in any way. Various changes may be made without departing from the spirit and scope of the present disclosure as defined in the following claims. While specific embodiments of the invention have been shown and described in detail to illustrate the application of the principles of the invention, it will be understood that the invention may be embodied otherwise without departing from such principles.

APPENDIX

List of Reference Designations

1 lower shell of a silencer housing
2 exhaust gas inlet pipe
21 portions of the exhaust gas inlet pipe with increased outer diameter
3 exhaust gas outlet pipe
4 exhaust gas outlet pipe
5 separate partition wall
6 coupling portion in the lower shell of the silencer housing
7 coupling portion in the upper shell of the silencer housing
8 sheet metal strip
10 silencer insert
11 first partition wall
12 second partition wall
13 connecting wall
14 coupling portion of the silencer insert
15 perforated area
16 elevated stiffening portion
17 through hole for an exhaust gas pipe
18 folded rim portion
81 cutting edge
E1 first plane
E2 second plane
E3 third plane

What is claimed is:

1. A silencer, comprising:

a housing; and a silencer insert received by said housing, the silencer insert comprising a first partition wall defining a first plane;

a second partition wall defining a second plane, the second plane being different from the first plane;

a connecting wall defining a third plane, the third plane being different from the first plane, the third plane being different from the second plane, and the connecting wall being arranged between the first partition wall and the second partition wall, wherein:

at least one wall of a wall group consisting of the first partition wall, the second partition wall, and the connecting wall comprises at least one perforated area;

the connecting wall is formed in one piece with both, the first partition wall and the second partition wall; and the first plane and the second plane are parallel or the first plane and the second plane are at an angle relative to each other of not more than 60°;

the housing comprising a housing coupling portion;

at least one wall of the wall group comprising an insert coupling portion at a perimeter thereof, which insert coupling portion is not connected to another wall of the wall group;

the insert coupling portion comprising at least one of a protrusion and recess along a coupling portion circumferential direction; and the insert coupling portion being configured for engaging the housing coupling portion.

2. The silencer according to claim 1, wherein the third plane and at least one of the first plane and the second plane are at an angle between 20° and 90° relative to each other.

3. The silencer according to claim 1, wherein:

at least one of the first partition wall, the second partition wall, and the connecting wall comprises a rim portion at a perimeter part not connected to another wall;

the perimeter part is folded by between 70° and 110° relative to a corresponding plane of the at least one of the first partition wall, the second partition wall, and the connecting wall or the perimeter part is folded to be perpendicular relative to the corresponding plane of the at least one of the first partition wall, the second partition wall, and the connecting wall; and the perimeter part forms a housing abutting face for abutting the housing.

4. The silencer according to claim 1, wherein:

the housing coupling portion has a bead shape or forms a protrusion extending into an interior of the housing; and the housing coupling portion engages the coupling portion of the silencer insert.

5. The silencer according to claim 1, wherein at least one of the first partition wall, the second partition wall, and the connecting wall comprises at least one elevated stiffening portion, the elevated stiffening portion defining a plane parallel to the plane defined by the respective wall and spaced from the respective wall by a distance that is at least double a wall thickness of the respective wall.

6. The silencer insert according to claim 1, wherein at least one of the first partition wall, the second partition wall, and the connecting wall comprises at least one through hole for an exhaust gas pipe.

7. The silencer according to claim 6, further comprising at least an exhaust gas pipe passing through the housing, wherein:

the exhaust gas pipe passes through the at least one through hole;

the exhaust gas pipe comprises, adjacent to the through hole, at least one portion with an exhaust gas pipe diameter that is increased relative to a diameter of the through hole or comprises, adjacent to the through hole, an exhaust gas pipe wall portion that is pressed radially outwards.

8. A method for manufacturing multiple silencer inserts from one single sheet metal strip, each silencer insert comprising a first partition wall defining a first plane, a second partition wall defining a second plane, the second plane being different from the first plane, a connecting wall defining a third plane, the third plane being different from the first plane, the third plane being different from the second plane, and the connecting wall being arranged between the first partition wall and the second partition wall, wherein at least one wall of a wall group consisting of the first partition wall, the second partition wall, and the connecting wall comprises at least one perforated area, the connecting wall is formed in one piece with both, the first partition wall and the second partition wall, and the first plane and the second plane are parallel or the first plane and the second plane are at an angle relative to each other of not more than 60°, the method comprising the steps of:

providing a sheet metal strip;

perforating the sheet metal strip to form at least one perforated area per silencer insert;

cutting portions of the sheet metal strip to size to form the first partition wall and the second partition wall as a pair of partition walls of each silencer insert which pair of partition walls are spaced apart by the connecting wall of each silencer insert;

bending the portion of the sheet metal strip forming the pair of partition walls with respect to the portion of the sheet metal strip forming the connecting wall by between 20° and 160°;

providing at least one through hole per silencer insert, for an exhaust gas pipe, in at least one wall of the wall group of each silencer insert; and cutting the connecting wall to size to separate the multiple silencer inserts from one another.

9. The method according to claim 8, further comprising the step of deep-drawing the sheet metal strip to form at least one elevated stiffening portion per silencer insert after the step of providing the sheet metal strip and before the step of cutting the portions of the sheet metal strip forming the partition walls of each silencer insert to size.

10. The method according to claim 9, further comprising the step of folding of rim portions of the portions of the sheet metal strip forming the partition walls of each silencer insert by between 70° and 110° after the step of cutting the portions of the sheet metal strip forming the partition walls of each silencer insert and before the step of bending the portion of the sheet metal strip forming the pair of partition walls with respect to the portion of the sheet metal strip forming the connecting wall by between 20° and 160°.

11. The method according to claim 9, further comprising the step of providing at least one through hole for an exhaust gas pipe in the connecting wall of each silencer insert after the step of providing at least one through hole for an exhaust gas pipe in at least one partition wall of each silencer insert and before the step of cutting the connecting wall to size.

12. The method according to claim 8, further comprising the step of folding of rim portions of the portions of the sheet metal strip forming the partition walls of each silencer insert by between 70° and 110° after the step of cutting the portions of the sheet metal strip forming the partition walls of each silencer insert and before the step of bending the portion of the sheet metal strip forming the pair of partition walls with respect to the portion of the sheet metal strip forming the connecting wall by between 20° and 160°.

13. The method according to claim 8, further comprising, after the step of cutting the connecting wall to size, folding rim portions, of the portion of the sheet metal strip forming the connecting wall of each silencer insert, by between 70° and 110°.

* * * * *